United States Patent [19]

Braddick

[11] 3,993,128

[45] Nov. 23, 1976

[54] WELL TOOL FOR SETTING AND SUPPORTING LINERS

[75] Inventor: Britt O. Braddick, Houston, Tex.

[73] Assignee: Texas Iron Works, Inc., Houston, Tex.

[22] Filed: Feb. 18, 1976

[21] Appl. No.: 658,914

[52] U.S. Cl. ..... 166/216

[51] Int. Cl.[2] ..... E21B 23/00

[58] Field of Search ..... 166/216, 217, 120, 121, 166/122, 137, 138, 140

[56] References Cited

UNITED STATES PATENTS

| | | | |
|---|---|---|---|
| 1,066,000 | 7/1913 | Grumpton | 166/216 |
| 2,156,939 | 5/1939 | Fulkerson | 166/140 |
| 2,345,888 | 4/1944 | Scott | 166/216 |
| 3,286,772 | 11/1966 | Solari et al. | 166/179 |

*Primary Examiner*—James A. Leppink
*Attorney, Agent, or Firm*—Jack W. Hayden

[57] ABSTRACT

A tubular mandrel is provided with outer housing means slidable thereon. Slip segments are formed on the outer housing means and a cone shaped enlargement is formed on the mandrel. Segmented cone means is slidably supported on the mandrel between the mandrel and outer housing means. Cooperating latch means including a J-shaped slot in the outer housing means receive lug means positioned on the mandrel. Bow spring means on the housing means engage the well bore casing as the tool is lowered into the well bore to position the lug in the J-slot so as to inhibit relative longitudinal and rotational movement between the mandrel and outer housing means. When the mandrel is moved in the other direction in the well bore casing and rotated, the outer housing is restrained by the bow spring means engagement with the well bore casing. The relative movement, longitudinal and rotational between the mandrel and housing positions the lug and slot to thereafter accommodate longitudinal movement of said mandrel in said outer housing to engage said slip segments, segmented cone means and cone shaped enlargement for urging said slip segments radially into gripping engagement with an enlarged well bore casing.

6 Claims, 3 Drawing Figures

WELL TOOL FOR SETTING AND SUPPORTING LINERS

SUMMARY OF THE INVENTION

The use of slips and a cone shaped enlargement for urging slips radially is well known and has been used for a number of years in various oil tools as well as other application. It can be appreciated that the amount of radial expansion of the slip segments is limited by the size of the cone shaped member or enlargement which engages the slips and urges them radially outwardly as well as the diameter of the tubular member through which they are moved.

Thus, the radial expansion of the slips is limited since the slips as well as the cone shaped enlargement for engaging therewith to urge them radially outwardly must be of proper size to readily move through a well string without fear of hanging up the slips or the cone shaped enlargement within such well string.

In some instances it may be desirable to set the slips in a portion of a well bore which is of substantially larger diameter than the well bore casing through which the slip segments and cone shaped enlargement are initially moved. At the present time so far as known to applicant, the size of the well bore casing through which the setting tool is moved has heretofore limited the amount of radial expansion of the slips, and thus precluded setting a slip type hanging arrangement, such as employed in hanging a liner in a well bore casing, from being used in a larger receptacle positioned below the well string through which the slip segments and cone shaped enlargement are lowered.

The present invention overcomes this in that it provides an arrangement which can be moved through a well string of a predetermined diameter without prematurely hanging up or prematurely causing the slips to actuate and grip the well string, while permitting such arrangement to be moved into an enlarged portion of substantially greater diameter for thereafter radially expanding the slips in a manner to grippingly engage the enlarged section of the well bore casing.

DESCRIPTION OF THE PREFERRED EMBODIMENT

Figure 1:
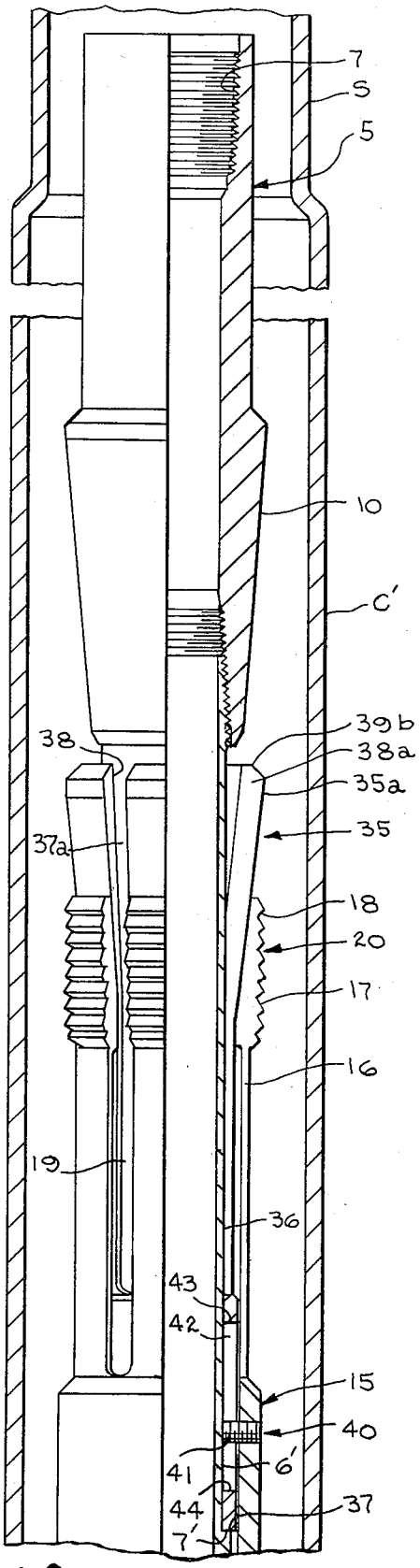
FIG. 1 is a longitudinal quarter sectional view illustrating the upper portion of the tool of the present invention with a well bore string shown in half section.

Attention is first directed to FIG. 1 of the drawings wherein a tubular mandrel is referred to generally by the numeral 5. The mandrel 5 is formed of a plurality of tubular sections which may be threadedly engaged and is provided with a threaded box end 7 for securing with a liner setting arrangement the construction and operation of which is well known in the art and forms no part of the present invention. The liner setting well string (not shown) extends to the earth's surface to enable the present invention to be lowered and positioned in the well string. The lower end 8 of the mandrel 5 is provided with threads 9 for receiving a liner thereon which is to be supported within the well bore casing by the arrangement shown in FIGS. 1 and 2 of the drawings.

A cone shaped enlargement 10 is provided on the mandrel 5 and outer housing means referred to generally at 15 receives the mandrel 5 therein. Cooperating latch means referred to generally at 25 are provided for releasably securing the mandrel 5 and outer housing 15 together, which latch means may be actuated to release the housing and mandrel for relative longitudinal movement as will be described.

Segmented cone means referred to at 35 is slidably supported on the mandrel 5 between the mandrel 5 and outer housing 15.

The outer housing 15 includes slip means referred to generally at 20 and the cone shaped enlargement 10 and segmented cone means 35 cooperate to expand the slip means 20 into gripping engagement with an enlarged diameter section of the casing string as will be described.

Figure 2:
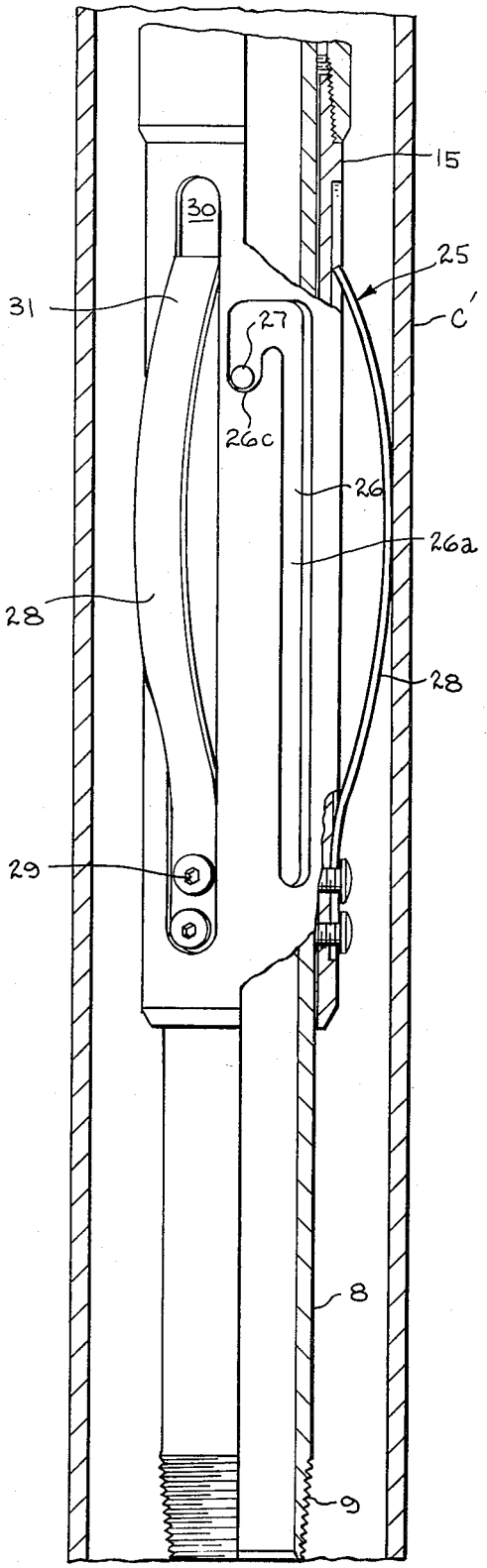
FIG. 2 is a quarter sectional view, partly in elevation and is a continuation of the tool shown in FIG. 1.

The cooperating latch means 25 includes at least one J-shaped slot 26 extending through the outer housing 15 as shown in FIG. 2. Lug means 27 formed on the mandrel 5 engages within the slot, and as shown in FIG. 2 of the drawings is in the end portion **26*c* of the J-slot 26 which aids in restraining longitudinal and rotational movement between the tubular mandrel 5 and outer housing 15** as the present invention is lowered in the well bore.

Bow spring means 28 are secured on the outer housing means 15 by any suitable means such as the means 29 and frictionally engage the well string to maintain the lug 27 and J-slot in the relative position shown in FIG. 2 as the tool is lowered into the well bore.

Longitudinally extending slots 30 in housing 15 receive the free end 31 of each of the bow spring means 28 to accommodate collapsing and expansion of the bow spring means as the present invention moves through a well string. The frictional engagement of the bow springs 28 with the inner surface of the casing represented at S as the present invention is lowered in a well bore urges the outer housing 15 to the position illustrated in FIGS. 1 and 2 of the drawings so that the lug means 27 is positioned in the end portion **26*c* of the slot 26 as shown in FIG. 2 to inhibit relative longitudinal and rotational movement between the mandrel 5 and outer housing 15**.

The slip means 20, while being integrally formed on the outer body 15 are formed on a portion 16 of the body which is of relative thinner wall thickness than the portion of the body on which the bow spring means 28 are mounted. The slip means 20 include the enlarged slip segments 17 at one end of the thinner wall portion 16, such slip segments 17 having serrations or teeth 18 thereon as shown to frictionally engage as will be described.

In addition, a plurality of longitudinally extending and circumferentially spaced grooves 19 are formed in the portion 16 and extend as shown to circumferentially space the slip segments 17 from each other.

The segmented cone means 35 is formed on the tubular portion 36 positioned on the mandrel 5 between such mandrel and the outer body or housing 15. An annular recess 6' formed on the outer surface of the mandrel 5 terminates in the shoulder 7' against which the end 37 of the tubular portion 36 abuts and serves to seat the tubular portion 36 and retain the segmented cone means 35 in a predetermined longitudinal relationship on the mandrel 5 as the mandrel 5 is lowered through the well string. The tubular portion 36 is provided with a plurality of longitudinally extending, circumferentially spaced slots 37*a* which intersect one end 38 of such tubular portion 36, the slots 37*a* being circumferentially aligned with the slots 19 of the housing portion 16. Enlargements 38*a* on one end of tubular portion 36 are circumferentially spaced by the slots 37*a* in the tubular portion 36 to provide cone segments 39*b* having tapered surfaces 35*a* thereon.

Cooperating means referred to generally at 40 maintain the slip segments 17 aligned with the cone segments 39*b* so that each slip segment 17 will always remain in engagement with the tapered surface 35*a* on one of the cone segments 39*b* during actuation and operation of the tool.

The cooperating means 40 includes the lug 41 which is secured to the outer housing 15 and fits within the longitudinal slot 42 formed in the cylindrical portion 36 and adjacent but spaced from the end 37 of tubular portion 36 as shown in the drawings. Thus, the cylindrical portion 36 and the segmented cone means 35 are secured to the housing 15 so as to inhibit or prevent relative rotation therebetween. It can be appreciated that when the cone shaped enlargement 10 engages with the segmented cone means 35, the grooves 37*a* in cylindrical portion 36 will spread as the cone segments 39*b* are moved radially outwardly. Since the cone segments 39*b* and the slip segments 17 maintain their longitudinal alignment as the slip segments 17 are moved up on the tapered surfaces 35*a* and as the segmented cone means 35 move up onto the cone shaped enlargement 10, each slip segment 17 will remain engaged with the tapered surface 35*a* of one of the cone segments 39*b* with which it is aligned and will not tend to move to overlap the grooves 37*a* as such grooves enlarge.

It will be further noted that the lug 41 is positioned in the groove 42 so as to be spaced relative to or away from each of the ends 43 and 44 of the groove 42 to enable manipulation of the tool for release of the cooperating latch means 25.

Figure 3:
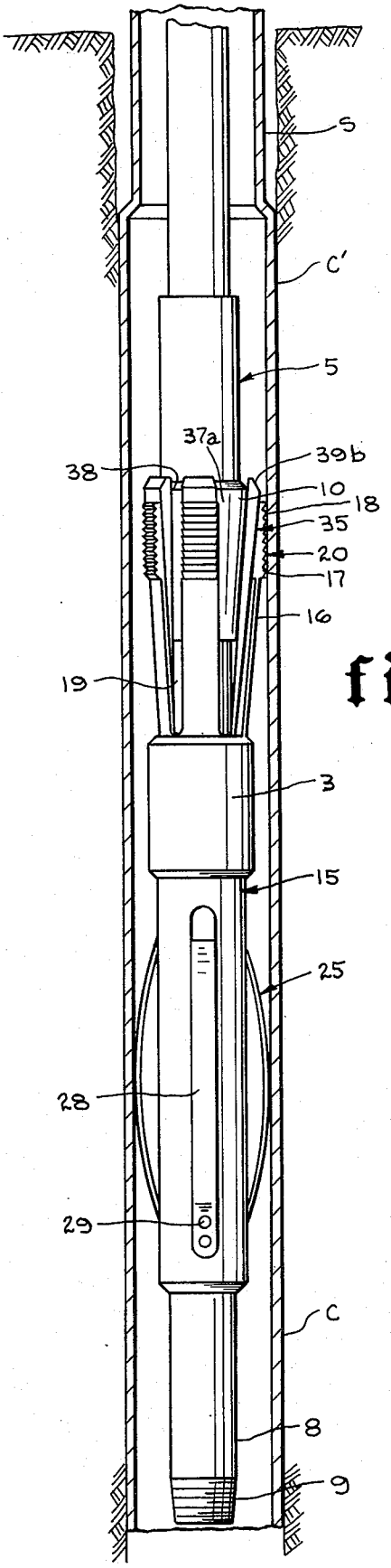
FIG. 3 illustrates the arrangement of the present invention actuated and seated in an enlarged section of well casing in a well bore.

After the mandrel 5 has been lowered through the well bore casing S on the liner setting string and into the enlarged portion C′ of the casing which is of substantially greater diameter than the casing portion S as illustrated in FIGS. 1 and 3 of the drawings, the present invention may be actuated so as to move the slip means 20 into gripping relationship with the enlarged portion C′ as shown in FIG. 3 of the drawings. Release of the latch means 25 is accomplished by an upward strain on the well string which extends to the earth's surface and on which the present invention is supported in the well bore casing, and as such upward strain or pull is effected, the bow spring means 28 frictionally engage the inner surface of the enlarged casing C′ and restrain upward movement of the housing 15 relative to the mandrel 5. When this occurs, the lug means 27 is moved upwardly out of the end 26*c* of the J-slot shown in FIG. 2. The mandrel 5 may be then rotated to the left and the housing 15 is restrained by the bow spring means 28 which enables the lug 27 on the mandrel 5 to be aligned with the portion 26*a* of the J-slot.

Thereafter, the mandrel 5 may be lowered whereupon the bow string means 28 tends to retain the outer housing 15 stationary in the enlarged casing portion C′ and downward movement of the mandrel 5 engages the cone shaped enlargement 10 with the segmented cone means 35 to move the cone segments 39*b* radially outwardly along with the slip segments 17. Further downward movement of the mandrel 5 with the cone shaped enlargement 10 thereon forces the cone segments 39*b* downwardly whereupon the slip means 20 moves upwardly along the tapered surfaces 35*a* to frictionally grip and engage the serrations 18 with the inner surface of the enlarged portion C′. The final relationship of the enlargement 10 on mandrel 5 with the segmented cone means 35 and slip means 20 is shown in FIG. 3 and when in this position the present invention is firmly seated in the enlarged portion C′.

Thereafter the setting tool which lowered the arrangement of the present invention into the well bore casing is disconnected by means well known in the art and the present invention along with the casing hanger structure (not shown) is left in its position in the well bore.

The foregoing disclosure and description of the invention are illustrative and explanatory thereof, and various changes in the size, shape, and materials as well as in the details of the illustrated construction may be made without departing from the spirit of the invention.

What is claimed is:

1. An arrangement for setting and supporting a liner in a well bore casing comprising:

a. a tubular mandrel;

b. a cone shaped enlargement on said mandrel;

c. outer housing means slidable on said mandrel;

d. slip means on said outer housing means;

e. segmented cone means slidably supported on said mandrel between said mandrel and said outer housing means;

f. cooperating latch means on said mandrel and outer housing means for releasably securing them together;

g. said latch means including:

1. a J-shaped slot in said housing means;

2. lug means on said mandrel and engaged in said slot; and 3. bow spring means on said outer housing means engageable with the well bore casing whereby as the mandrel and outer housing means move through the well bore casing in one direction said lug means is positioned in said slot to restrain relative longitudinal and rotational movement between said mandrel and outer housing, and said latch means, upon longitudinal movement of said mandrel in the other direction in the well bore casing and then rotating it while said outer housing means is restrained by said bow spring means engaging the well bore casing, releasing to accommodate longitudinal movement of said mandrel said outer housing means to engage said slip means, segmented cone means and cone shaped enlargement for urging said slip means radially into gripping engagement with the well bore casing.

2. The invention of claim 1 including shoulder means on said mandrel for seating said segmented cone means and to inhibit premature movement of said segmented cone means in a manner to prematurely radially expand said slip means toward gripping engagement with the well casing.

3. The invention of claim 1 wherein:

a. said slip means includes circumferentially spaced slip segments; and b. cooperating means connecting said outer housing means and said segmented cone means in predetermined longitudinal alignment as said slip segments, segmented cone means and cone shaped enlargement engage and move said slip segments radially.

4. The invention of claim 3 wherein said cooperating means includes lug means on said housing means engaged in longitudinal slot means in said segmented cone means.

5. The invention of claim 1 wherein said segmented cone, slip means and said cone shaped enlargement are retained in a predetermined relationship by said cooperating latch means to inhibit premature radial expansion of said slip means toward gripping engagement with the well casing.

6. The invention of claim 4 wherein said lug means is positioned in spaced relation to each end of said longitudinal slot means to accommodate relative longitudinal movement of said mandrel and segmented cone means without engaging said cone shaped enlargement on said mandrel and said segmented cone means while disengaging said latch means.

* * * * *